United States Patent [19]

Fischer

[11] Patent Number: 4,817,543

[45] Date of Patent: Apr. 4, 1989

[54] SEWING AUTOMAT WITH A SEWING HEAD INCLUDING A ROTARY HOUSING

[75] Inventor: Jochen Fischer, Detmold, Fed. Rep. of Germany

[73] Assignee: Kochs Adler Aktiengesellschaft, Fed. Rep. of Germany

[21] Appl. No.: 70,913

[22] Filed: Jul. 8, 1987

[30] Foreign Application Priority Data

Jul. 31, 1986 [DE] Fed. Rep. of Germany ..... 3625882

[51] Int. Cl.[4] ..... D05B 19/00; D05B 69/00

[52] U.S. Cl. ..... 112/121.12; 112/220

[58] Field of Search ..... 112/121.11, 121.12, 112/184, 220, 259

[56] References Cited

U.S. PATENT DOCUMENTS

| | | | |
|---|---|---|---|
| 3,459,145 | 8/1969 | Ramsey et al. | 112/121.11 |
| 4,373,458 | 2/1983 | Dorosz et al. | 112/121.12 |
| 4,512,269 | 4/1985 | Bowditch | 112/121.12 |
| 4,574,718 | 3/1986 | Scholl et al. | 112/121.12 |
| 4,674,421 | 6/1987 | Iwase | 112/121.12 |

FOREIGN PATENT DOCUMENTS

| | | | |
|---|---|---|---|
| 2528080 | 12/1983 | France | 112/121.11 |
| 60-21750 | 5/1985 | Japan | 112/121.11 |
| 60-21751 | 5/1985 | Japan | 112/121.11 |

*Primary Examiner*—William C. Reynolds

*Attorney, Agent, or Firm*—Laff, Whitesel, Conte & Saret

[57] ABSTRACT

At a sewing automat the sewing head is provided with a rotary housing incorporating a needle bar, a needle bar jogging mechanism and a thread take-up mechanism and a rotatable hook bearing receiving a hook, in order to generate a tangentially directed needle feed movement of the needle relative to the seam to be produced. In order to achieve constant lengths of stitches at swivel motions of the rotary housing and the hook bearing a rotary position indicator associated to a central control unit is connected to a main drive shaft, wherein the rotary position indicator puts out a pre-given number of pulses per revolution of a main drive shaft. The main drive shaft and an adjusting shaft are operably connected to the rotary position indicator via a differential gear in such a manner that at swivelling of the adjusting shaft the rotary position indicator generates a number of pulses corresponding to the swivelling of the adjusting shaft.

4 Claims, 5 Drawing Sheets

SEWING AUTOMAT WITH A SEWING HEAD INCLUDING A ROTARY HOUSING

FIELD OF THE INVENTION

The invention relates to a sewing automat with a sewing head and a device for generating a two-axis-relative movement between a workpiece to be sewn and the sewing head including a rotary housing supported at said sewing head and swivelling drivable about an axis of rotation by an adjusting shaft, said rotary housing having a needle bar with a needle supported in said rotary housing and reciprocatingly drivable via a crank drive driven by a common drive, which common drive is drivable by a main drive shaft of said sewing head, the needle having a needle axis being identical with said axis of rotation, a needle jogging gear connected to said crank drive for generating a needle feed movement, and a thread take-up lever drive coupled to said crank drive, a hook bearing swivelling drivable by said adjusting shaft about said needle axis equiangularly to said rotary housing, a hook arranged in said hook bearing and drivable by said main drive shaft, a drive motor for driving said main drive shaft, an adjusting drive for driving said adjusting shaft, and a central control unit for controlling the drive motor and the adjusting drive.

BACKGROUND OF THE INVENTION

U.S. Pat. No. 4,574,718 shows such an automatic sewing device, wherein the needle feed movement is always tangentially directed with respect to the seam at the individual position of stitch formation, so that no mentionable forces of displacement between the workpiece and the needle occur. At such a known automatic sewing device there exists the problem that at a rotation of the rotary housing and the hook bearing, the needle bar, the needle jogging drive, and thread take-up lever mechanism and the hook will be altered in their positions relative to each other resulting in stitch length variations. These variations increase proportionally with the angle of rotation per stitch about which the rotary housing and the hook bearing are swivelled. This problem also occurs when, for example, a swivelling of the rotary housing and the hook bearing should be carried out while the needle has come to a standstill within the workpiece, because the needle due to the needle jogging mechanism is exposed to a lateral jogging motion. Due to this problem it is not possible to generate a so-called corner stitch, which may occur as a decorative stitch for example at a shirt collar.

U.S. Pat. No. 2,203,804 shows a two-needle sewing machine, which serves for the production of so-called cork-screw thread seams. At such machines positively and non-avoidably the length of the stitch will be altered at a bent contour of the seam to be produced. The reason for this is the fact that at these sewing machines the swivelling axis of the stitch forming tools does not coincide with the individual axis of the separate needles. For this reason the driving phase between hook and needle alters. Due to this problem in a shaft of a hook swivelling drive there must be interposed a differential gear, which maintains the drive phase of the stitch forming tools to each other. The problems arising at such sewing machines are totally different to the afore-described problems.

SUMMARY OF THE INVENTION

It is a main object of the invention to provide an automatic sewing device of the type described above, in which swivelling movements of the rotary housing and the hook bearing do not influence the position of the stitch forming tools.

This object is achieved by coupling a rotary position indicator associated to the central control unit to the main drive shaft, which rotary position indicator generates a pre-set number of pulses per revolution of the main drive shaft. Furthermore, the main drive shaft and the adjusting shaft are coupled with the rotary position indicator via a differential gear in such a way that upon swivelling of the adjusting shaft the rotary position indicator generates a number of pulses corresponding to the swivelling of the adjusting shaft. According to the invention the drive power portion and the adjusting power portion are fed directly to the sewing head. A compensating pulse sequence is produced via the differential gear in a rotary position indicator upon swivelling movements of the rotary housing and the hook bearing. This pulse sequence allows the drive motor to follow correspondingly. Thus, through a corresponding control of the drive motor upon a swivelling movement of the rotary housing and the hook bearing the main drive shaft is decelerated or accelerated in order to compensate changes in position of the needle bar, the needle bar joggig frame, the thread take-up lever drive mechanism and the hook resulting from the afore-mentioned swivelling movements.

Numerous further advantages and features of the invention will become apparent from the following description of an embodiment with reference to the drawings.

DETAILED DESCRIPTION OF THE EMBODIMENT

Figure 1:
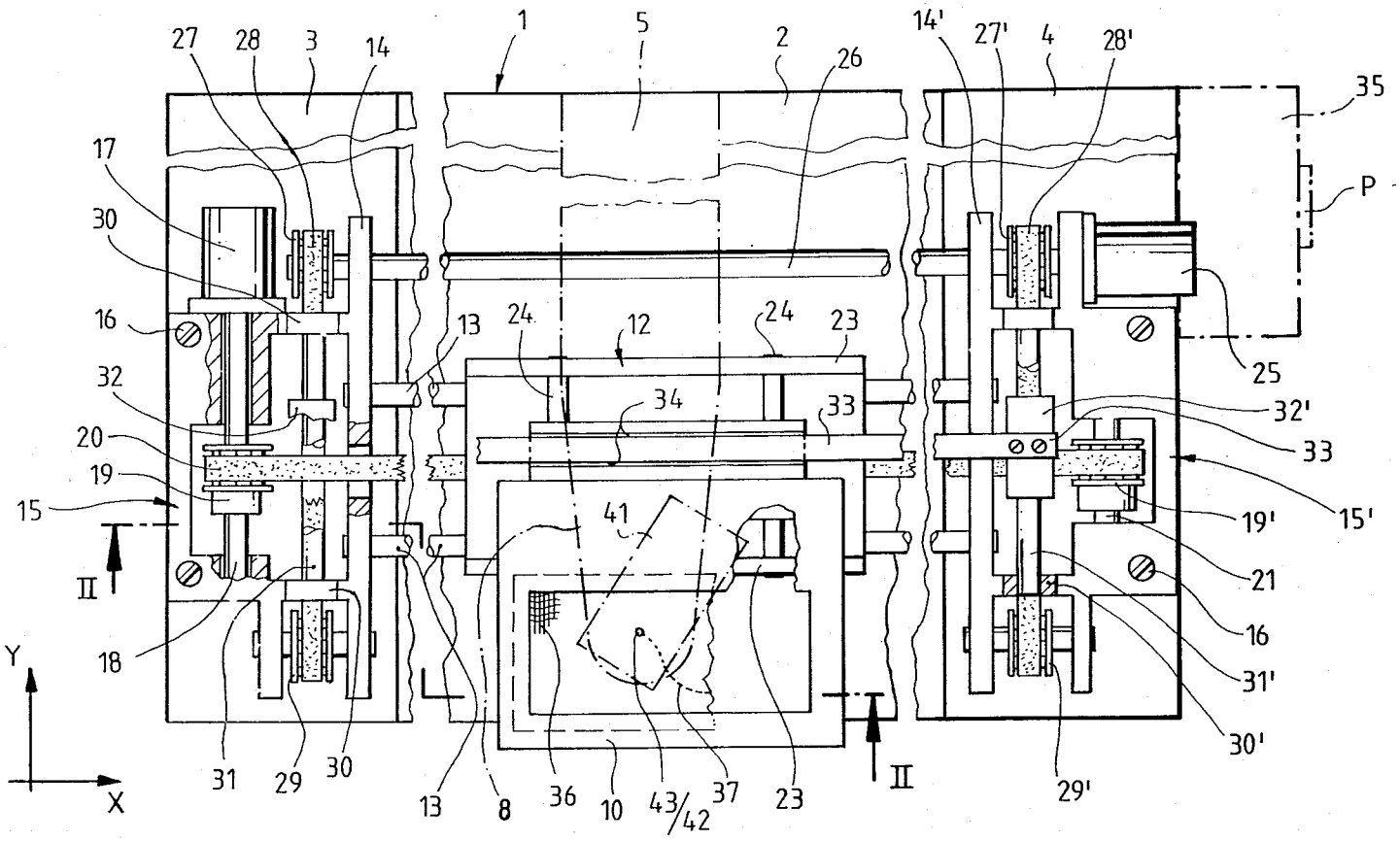
FIG. 1 is a top plan view of an automatic sewing device according to the invention in the direction of arrow I in FIG. 2, a sewing head only being indicated by dot-dash-lines.

Referring to the drawings there is illustrated an automatic sewing device mounted to a stand 1 comprising an intermediate section 2 and two lateral sections 3 and 4. On the intermediate section 2 of the stand 1 there is arranged a sewing head 5, the base plate 6 of which is mounted to the intermediate section 2. The sewing head 5 is formed with a standard 7 extending upwardly from the base plate 6, and an upper arm 8 extending from the standard 7 in parallel with respect to the base plate 6. In the area of the free ends of the base plate 6 and the upper arm 8 there are arranged stitch forming instruments 9. Between the base plate 6 and the upper arm 8, i.e. in the area of the stitch forming instruments 9, there is arranged a workpiece holder 10 movable into two directions of coordinates, i.e. in y-direction corresponding to the main direction of the sewing head 5, and in x-direction extending perpendicularly thereto as obvious from FIG. 2. The workpiece holder 10 is associated to an x-y-carriage-system. This system provides a y-carriage 11 and an x-carriage 12, wherein the workpiece holder 10 is directly connected to the y-carriage 11. The y-carriage 11 is supported and guided on the x-carriage 12 and displaceable in y-direction relative to the x-carriage 12. The x-carriage 12 is displaceble in x-direction relative to the stand 1. Consequently, the y-carriage 11 together with the workpiece holder 10 is displaceable in x- and y-direction relative to the stand 1.

The x-carriage 12 is displaceably arranged on two guide rods 13, which are stationarily mounted to the stand 1 and which extend parallel to each other. The guide rods 13 are received with each of their ends in bearing webs 14, 14' of bearing blocks 15, 15' mounted to the two lateral sections 3 and 4, respectively, of the stand 1 by means of screws 16 .

Figure 2:
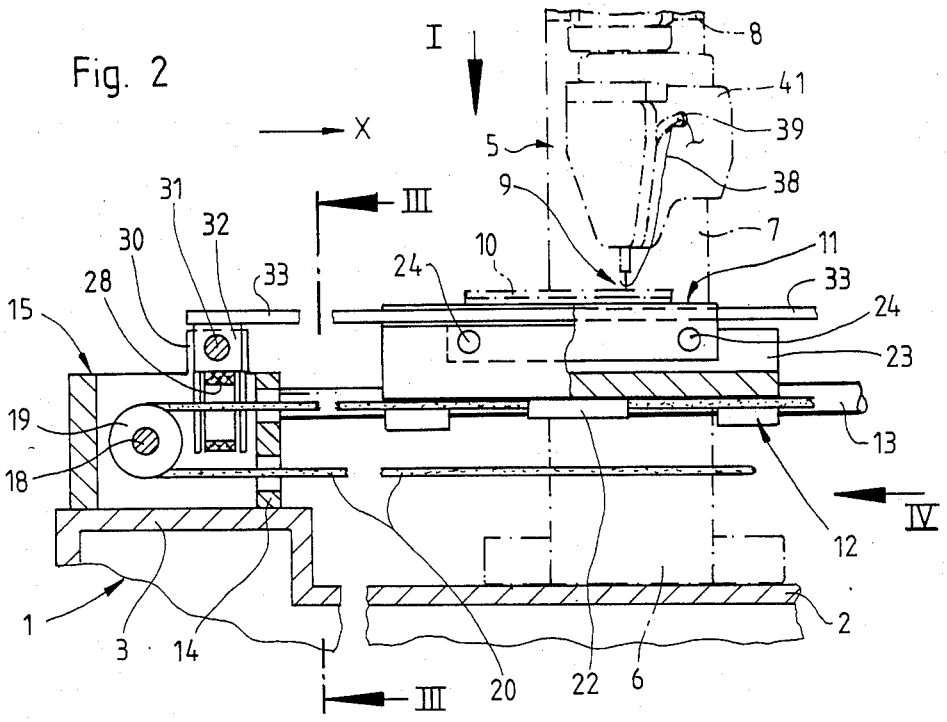
FIG. 2 is a vertical partial section taken along line II—II in FIG. 1.
Figure 3:
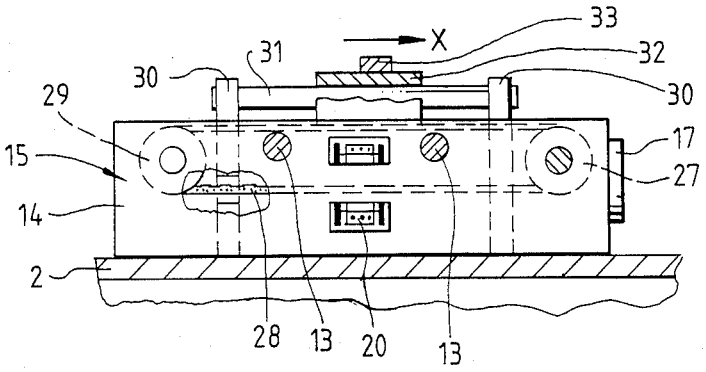
FIG. 3 is a vertical partial section taken along line III—III in FIG. 2.
Figure 4:
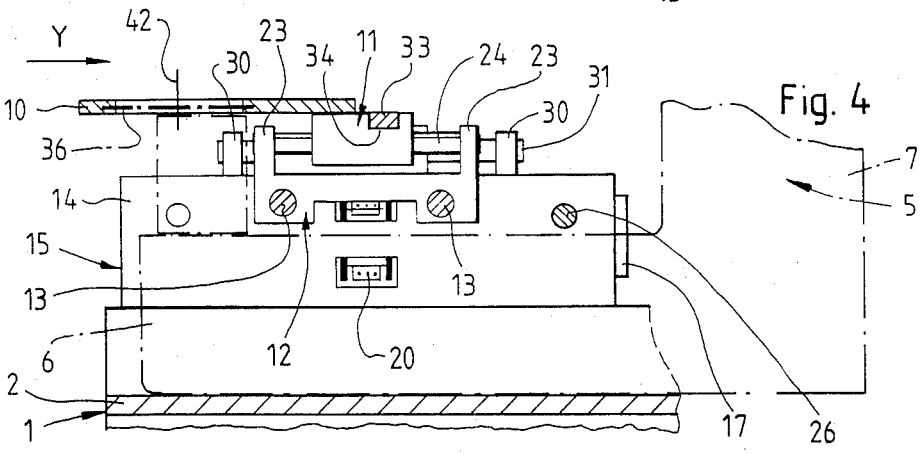
FIG. 4 is a partial side elevation in the direction of the arrow IV in FIG. 2.

To one bearing block 15, which is shown in FIGS. 1 and 2 associated to the left lateral section 3, there is mounted a drive motor 17 for the x-carriage 12. This motor 17 drives a timing belt pulley 19 via a shaft 18, which is supported in the bearing block 15. The timing belt pulley 19 in turn drives an endless timing belt 20 via a timing belt pulley 19'. The timing belt pulley 19' is rotatably supported via an axis 21 in the bearing block 15' located in the right lateral section 4 of the stand 1. The upper strand of the timing belt 20 is secured to the lower surface of the x-carriage 12 by means of a fastening means 22, so that the x-carriage 12 may be displaced on the guide rods 13 in x-direction when correspondingly driven by the drive motor 17. The x-carriage 12 is provided with side walls 23, which extend in x-direction and carry guide rods 24 extending in y-direction. The y-carriage 11 is supported on the guide rods 24 and displaceable in y-direction.

The drive of the y-carriage 11 is accomplished by a drive motor 25. The drive motor 25 is mounted to the bearing block 15' and directly drives a shaft 26 supported in the two bearing blocks 15, 15'. The shaft 26 extends in x-direction. In both bearing blocks 15, 15' timing belt pulleys 27 and 27', respectively, are fixedly mounted to the shaft 26, i.e. the timing belt pulleys 27 and 27', respectively, are rotatingly drivable by the shaft 26. These timing belt pulleys 27 and 27', respectively, each drive an endless timing belt 28 and 28', respectively. Each of the timing belts 28, 28' is guided via timing belt pulleys 29, 29' also supported in the bearing block 15 and 15', respectively. In parallel with and above the timing belts 28, 28' guide rods 31, 31' are mounted in webs 30, 30' of each bearing block 15, 15'. To each of the guide rods 31, 31' there is mounted a slide bearing 32 and 32', respectively, displaceable in y-direction. The two slide bearings 32, 32' arranged oppositely to one another are connected by a guide bar 33 extending in x-direction. Each end of the guide bar 33 is screwed to the corresponding slide bearing 32 or 32', respectively. The guide bar 33 engages a guide groove 34, which is located in the upper surface of the y-carriage 11 and which is matched to the outer circumference of the guide bar 33. The guide groove 34 and the guide bar 33 have no clearance in the y-direction, but they are displaceable to each other in their longitudinal directions, i.e. in x-direction. Due to the drive of the guide bar 33 in y-direction, i.e. transversally with respect to its longitudinal direction, by means of the timing belts 28, 28' engaging the two ends of the guide bar 33 via the slide bearings 32, 32' a canting-free drive of the y-carriage 11 in y-direction is achieved. Movements of the y-carriage 11 together with the x-carriage 1 in x-direction are possible without problems since the guide bar 33 absolutely extends in parallel with the guide rods 13, while a correct drive and a correct guidance in y-direction is achieved due to the fact that the guide rods 31, 31' absolutely extend in parallel with the guide rods 24.

The drive motors 17 and 25 may be designed as step motors or DC-motors with position feed-back, which effect a very precise program-controlled drive of the x-carriage 12, the y-carriage 11 and thus the workpiece holder 10 in x-y-direction.

For the program-controlled drive there is provided a control unit 35 with a receptacle for a program P. In the workpiece holder 10 there is clamped a workpiece 36, in which is produced a seam 37 by means of the stitch forming instruments 9 as will be described hereinafter. For producing the seam 37, a needle thread 38 is guided from a spool (not shown) via a thread take-up lever 39 to the stitch forming instruments 9.

Figure 5:
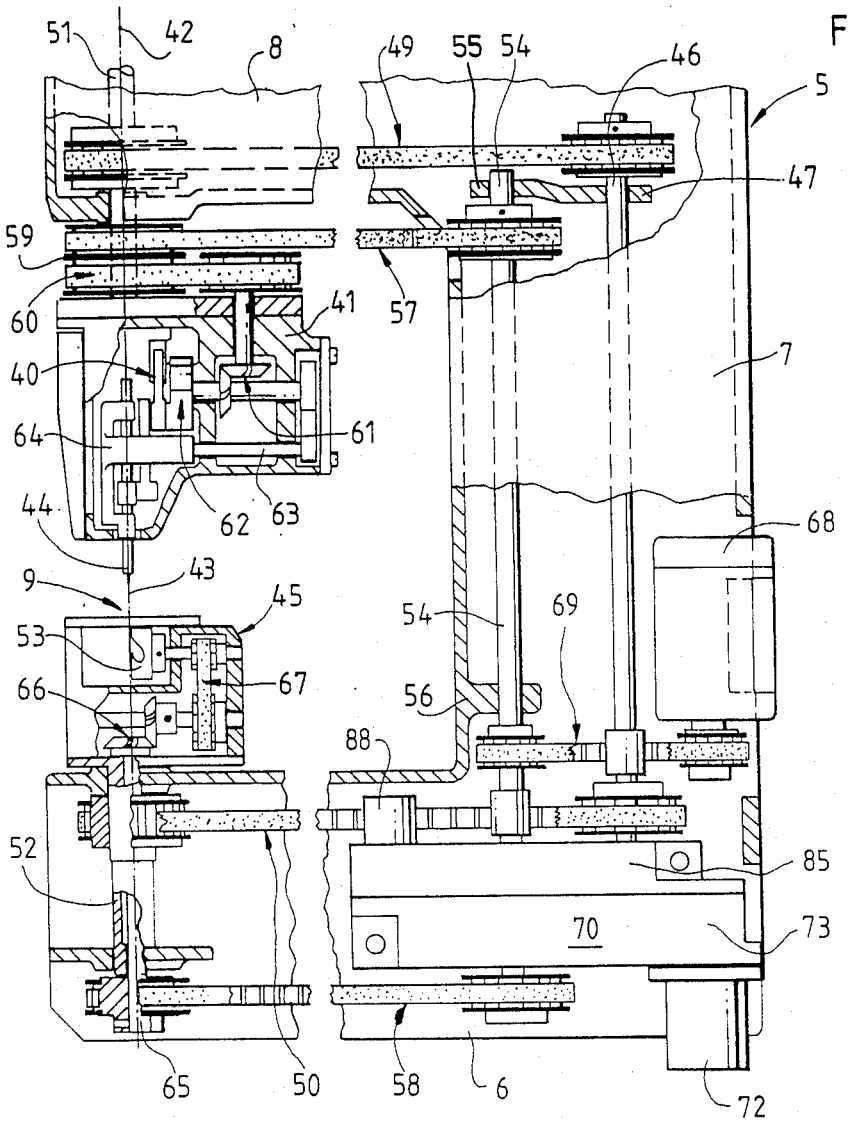
FIG. 5 is a vertical section through the sewing head, an upper arm of which being partially broken away.

The construction of the sewing head 5 substantially is obvious from FIG. 5. At the lower surface of the free end of the upper arm 8 there is supported a rotary housing 41 rotatable about an axis 42. Aligned to this axis 42 there is arranged a needle bar 44 carrying a needle 43. Below the rotary housing 41 and also flushing with the axis 42 there is arranged a hook bearing 45 on the base plate 6 formed as a housing. The hook bearing 45 is equiangularly swivelling or rotating together with the rotary housing 41. The swivel drive of the rotary housing 41 and the hook bearing 45 is effected by an adjusting shaft 46. The adjuusting shaft 46 is supported in bearings 47, 47' of the standard 7 and extends in parallel with the axis 42. From both ends of the adjusting shaft 46 timing belt drives 49, 50 are driven. The timing belt drive 49 arranged in the upper arm 8 drives the rotary housing 41 via a shaft 51 concentrically arranged with respect to the axis 42. The lower timing belt drive 50 arranged in the base plate 5 drives the hook bearing 45 via a hollow shaft 52. As the two timing belt drives 49, 50 have an identical transmitting ratio, both, the rotary housing 41 and the hook bearing 45, are equiangularly driven.

The needle bar 44 together with the needle 43 on one hand and the hook 53 in the hook bearing 45 on the other hand are driven by a common drive shaft 54 serving as a main drive shaft. The shaft 54 is supported in the standard 7 by means of bearings 55, 56 and extends in parallel with the adjusting shaft 46. The shaft 54 drives the needle bar 44 and the hook 53 via timing belt drives 57, 58 each located in the area of the ends of the drive shaft 54. The upper timing belt drive 57 associated to the upper arm 8 terminates in a double timing belt pulley 59 arranged concentrically with respect to the shaft 51 and thus with the axis 42. This pulley 59 is not connected to the shaft 51. The double timing belt pulley 59 drives via a further timing belt drive 60 located on the upper surface of the rotary housing 41, a bevel gear drive 61 situated in the rotary housing 41. The bevel gear drive 61 in turn drives a crank drive 62, which imparts oscillatory motions to the needle bar 44. Furthermore, the bevel gear drive 61 drives via a rocking shaft 63 a needle bar jogging frame 64, which imparts vibratory motions—so-called needle feed movements—to the needle bar 44. Moreover, the crank drive 62 also drives a thread take-up lever drive mechanism 40 for driving the thread take-up lever 39.

The lower timing belt drive 58 arranged in the base plate 6 drives a hook drive shaft 65 located in the hollow shaft 52. The hook drive shaft 65 drives the hook 53 via a bevel gear drive 66 provided inthe hook bearing 45, and a further timing belt drive 67. The design and the drive of the rotary h ousing 41 inclusive the needle bar 44 supported therein, of the needle bar jogging frame 64 and of the thread take-up lever drive mechanism 40 as well as the design and the drive of the hook bearing 45 inclusive the drive of the hook 53 located in the latter by the adjusting shaft 46 and the drive shaft 54, respectively, are known from U.S. Pat. No. 4,574,718, reference to which is expressively made in order to avoid repetitions.

The drive shaft 54 is driven by a drive motor 68 via a timing belt drive 69. The drive motor 68 is mounted to the standard 7 of the sewing head 5. The drive shaft 54 passes through a differential gear 70, at which a gear wheel serving as a sun wheel 71 is non-rotatably mounted to the drive shaft 54.

The adjusting shaft 46 is driven by a servo motor 72 mounted to the lower portion 73 of the housing of the differential gear 70, and supported via the already mentioned bearing 48 in the lower portion 73 of the housing of the differential gear 70. Moreover, the adjusting shaft 46 is provided with a gear wheel 74 meshing with the driving pinion 75 of the servo motor 72, which gear wheel is non-rotatable with respect to the adjusting shaft 46.

To the drive shaft 54 in the lower portion 73 of the housing there is—rotatably iwth respect to the drive shaft 54—supported a pinion cage 76, which is non-rotatably connected to a gear wheel 77 meshing with the gear wheel 74 of the adjusting shaft 46. Consequently, the pinion cage 76 is also driven by the servo motor 72. The pinion cage 76 usually provides axle journals 78, to which are rotatably supported planet pinions 79 meshing with the sun wheel 71. Each planet pinion 79 is formed in one piece with a gear wheel 80 having a smaller diameter d than the diameter D′ of the planet pinion 79. The smaller gear wheel 80 engages a gear wheel 81 rotatably supported on the drive shaft 54. The diameter D of the gear wheel 81 is larger than the diameter d′ of the sun wheel 71. As the gear wheels 80 and 81 have the same size, i.e. $d=D$, they have a gear ratio of "one". In contrast to this, the sun wheel 71 and the planet pinion 79 have a gear ratio of "unequal one", as the sun wheel 71 is smaller than the planet pinion 79, i.e. $d'<D'$. The planet pinion 79 and the gear wheel 80 form a double gear wheel. The same is valid to the gear wheels 81, 82. To the gear wheel 81 there is connected a further gear wheel 82, the diameter of which is larger than that of the gear wheel 81. The larger gear wheel 82 meshes with an intermediate wheel 83 supported on an axle journal 84. The axle journal 84 is secured at the upper portion 85 of the housing of the differential gear 70. The intermediate wheel 83 meshes with a gear wheel 86, which is non-rotatably connected to a shaft 87 of a rotary position indicator 88. All wheels are arranged parallel to each other, i.e. they rotate about axes extending parallel to each other and thus parallel with respect to the adjusting shaft 46 and the drive shaft 54, respectively.

Figure 9:
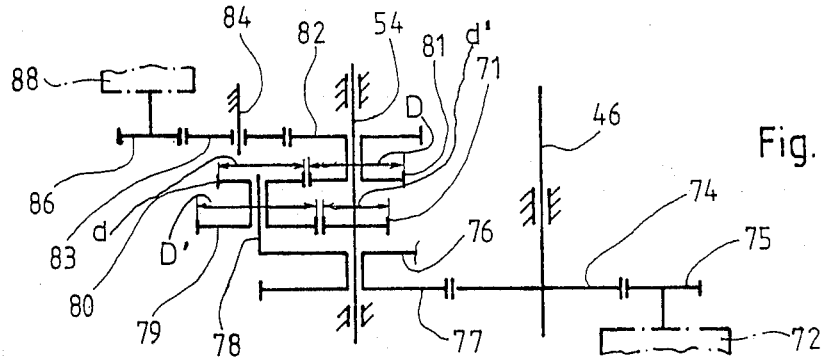
FIG. 9 is a schematic representation of the differential gear.
Figure 6:
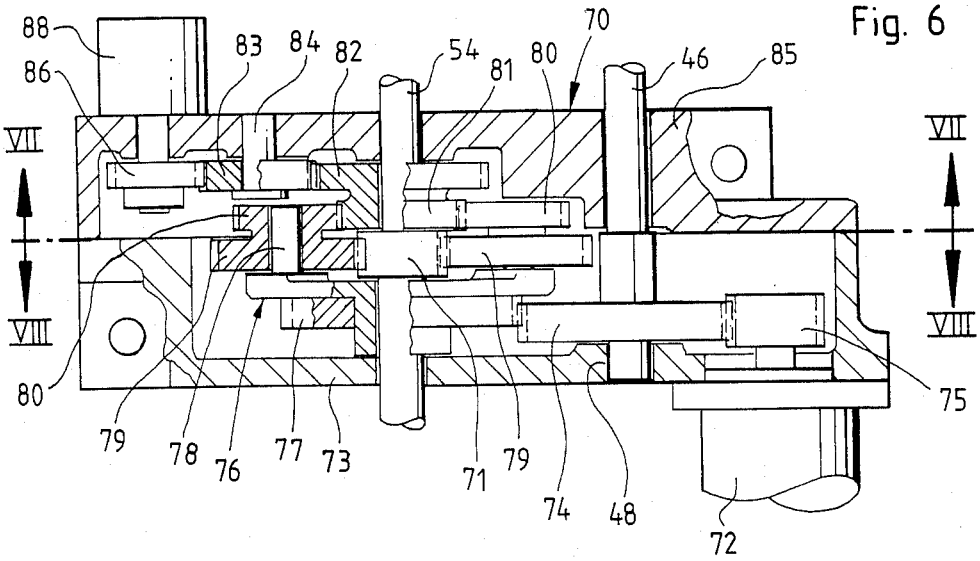
FIG. 6 is a vertical section through a differential gear of the sewing device.
Figure 7:
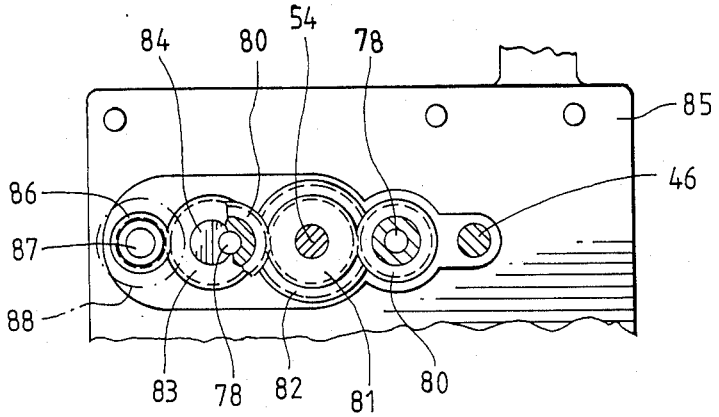
FIG. 7 is a section through the differential gear taken along line VII—VII in FIG. 6.
Figure 8:
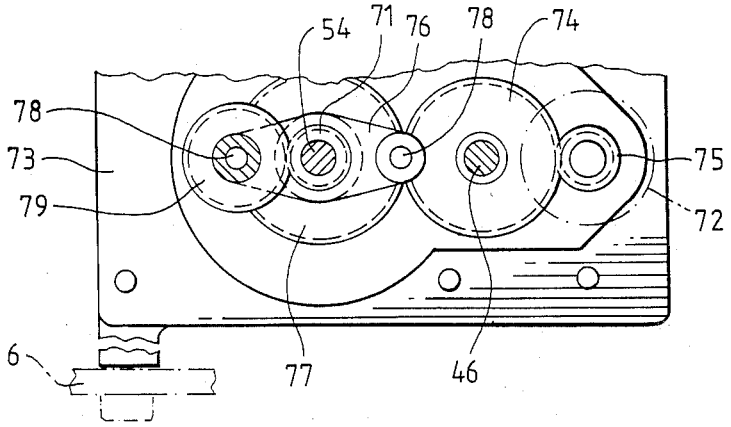
FIG. 8 is a section through the differential gear taken along line VIII—VIII in FIG. 6.

Operation is hereinafter described with reference to FIG. 9. It is assumed that the drive motor 68 as the main drive runs, while the servo motor 72 stands still. Consequently, a regular straight-lined sewing operation is performed, in which the needle 43 carries out a so-called needle feed movement. The sun wheel 71 and the drive shaft 54 rotate with the same RPM-rate. As the pinion cage 76 stands still, the planet pinions 79 are driven by the sun wheel 71. The intermediate wheel 83 and the gear wheel 86 of the rotary position indicator 88 are driven via the gear wheels 80, 81, 82. If the servo motor 72 stands still, then the rotary position indicator 88 is driven with an RPM-rate directly proportional to that of the drive shaft 54 and correspondingly imparts to the control unit 35 of the automatic sewing device a number of pulses per time unit directly proportional to this RPM-rate.

When the drive motor 68 as the main drive stands still, however the servo motor 72 is driven, then the pinion cage 76 is driven via the gear wheels 74, 77. Hereby the planet pinions 79 ride on the standing still sun wheel 71 and impart via the rotated gear wheel 80 a rotary motion to the rotary position indicator 88. This rotary motion, which corresponds to the swivel motion of the rotary housing 41 and the hook bearing 45, is transmitted to the rotary position indicator 88 via the gear wheels 80, 81, 82, the intermediate wheel 83 and the gear wheel 86 causing the rotary position indicator 88 to generate and transmit to the control unit 35 a number of pulses per time unit corresponding to the swivel motion of the rotary housing 41 and the hook bearing 45. Due to this pulse generating the control unit 35 causes the drive motor 68 to rotate the drive shaft 54 equiangularly and in the same direction with respect to the rotation of the adjusting shaft 46, so that finally the movement of the stitch forming instruments 9 is not influenced in spite of the rotation of the rotary housing 41 and the hook bearing 45. When both the drive motor 68 and the servo motor 72 run, wherein the latter is operated for performing a swivel motion of the rotary housing 41 and the hook bearing 45, then both the described motions superpose each other with the consequence that the rotary position indicator 88 generates a sequence of pulses per time unit, which is larger or smaller as corresponding to the RPM-rate of the drive shaft 54. This results in that the drive motor 68 will be decelerated or accelerated by the control unit 35 of the sewing automat, so that the drive motor 68 will be exactly controlled in order to achieve a constant length of stitch. If such a control of the drive motor 68 were not performed, then at a swivel motion of the rotary housing 41 the needle bar 44, the thread take-up lever drive mechanism 40 and also the needle bar jogging frame 64 would carry out a motion due to the roll-off motion of the timing belt drive 60 and the double timing belt pulley 59. In the same manner the hook 53 would be rotated to a roll-off motion within the bevel gear drive 66. This would result in an alteration of the position of the needle 43 and the hook 53, which at running machine would lead to an alteration of the stitch length, wherein the alteration would be the larger the larger the tilt angle per stitch of the rotary housing 41 and the hook bearing 45 would be. This undesired alteration in position of the needle bar 44 and the needle bar jogging frame 64 and the hook 53 will be compensated due to the described control of the drive motor 68. In the workpiece 36 held by the workpiece holder 10 there will be generated a seam 37 in such a manner that the needle feed movement of the needle 43 is always tangentially performed as this has been described in detail in the already mentioned U.S. Pat. No. 4,574,718.

The control of the drive motor 68 serving as main drive, the servo motor 72 and also the drive motors 17 and 25 for the carriages 11, 12 inclusive the workpiece holder 10 is accomplished by the control unit 35 according to a programmed program P.

Figure 10:
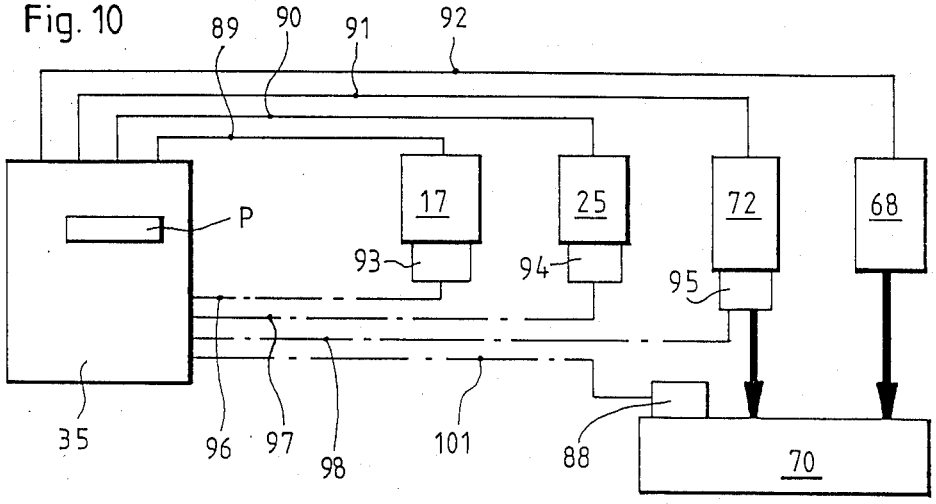
FIG. 10 is a block diagram showing the control of the differential gear by a control unit.

As obvious from FIG. 10 this control of the different motors 17, 25, 68 and 72 is carried out via electrical cables 89, 90, 91 and 92 connecting the motors to the control unit 35. The motors 17, 25, 72 are provided with rotary position indicators 93, 94, 95 which pass signals presenting the angular position of the corresponding motors to the control unit 35.

The rotary position indicator 88 transmits signals via a cable 101 to the control unit 35, wherein the signals represent the value and the direction of the swivel angle. By the employment of the differential gear 70 it is achieved that the rotary position indicator 88 represents the actual swivel angle position of the crank drive 62 respectively the stitch forming instruments 9 independent of the swivel angle position of the rotary housing 41 and the hook bearing 45.

As obvious from the description and FIG. 10, the motors 17, 25 and 72 are independent variables—as expressed in control-technique language - which will be controlled by the control unit 35 according to different marginal requirements and the program P determining the geometry of the seam 37 to be stitched. Contrary to this, the motor 68 represents a depending variable. By these described measures an electro-mechanical compensation of the undesired motion of the stitch forming instruments 9 at swivelling of the rotary housing 41 and the hook bearing 45 will be achieved.

What is claimed is

1. A sewing automat with a sewing head (5) and a device for generating a two-axis-relative movement between a workpiece (36) to be sewn and the sewing head (5) including:

a rotary housing (41) supported at said sewing head (5) and swivelling drivable about an axis of rotation by an adjusting shaft (46), said rotary housing (41) having:

a needle bar (44) with a needle (43) supported in said rotary housing (41) and reciprocatingly drivable via a crank drive (62) driven by a common drive, which common drive is drivable by a main drive shaft (54) of said sewing head (5), the needle having a needle axis (42) being identical with said axis of rotation, a needle jogging gear (63, 64) connected to said crank drive (62) for generating a needle feed movement, and a thread take-up lever drive (40) coupled to said crank drive (62), a hook bearing (45) swivelling drivable by said adjusting shaft (46) about said needle axis (42) equiangularly to said rotary housing (41), a hook (53) arranged in said hook bearing (45) and drivable by said main drive shaft (54), a drive motor (68) for driving said main drive shaft (54), an adjusting drive for driving said adjusting shaft (46), and a central control unit (35) for controlling the drive motor (68) and the adjusting drive, a rotary position indicator (88) associated to the central control unit (35) and coupled to the main drive shaft (54), which rotary position indicator (88) generates a pre-set number of pulses per revolution of the main drive shaft (54), and the main drive shaft (54) and the adjusting shaft (46) being coupled to the rotary position indicator (88) via a differential gear (70) in such a way that upon swivelling of the adjusting shaft (46) the rotary position indicator (88) generates a number of pulses corresponding to the swivelling of the adjusting shaft (46).

2. A sewing automat according to claim 1, wherein the differential gear (70) is provided with a sun wheel (71) fixed on the main drive shaft (54) driven by the drive motor (68), which sun wheel (71) meshes with at least one planet pinion (79) borne on a pinion cage (76) drivable by the adjusting drive and which is in rotary driving connection with the rotary position indicator (88).

3. A sewing automat according to claim 2, wherein a gear wheel (80) is coaxially firmly connected with the at least one planet pinion (79), which gear wheel (80) meshes with a gear wheel (81) freely rotatably supported on the main drive shaft (54), the gear wheel (81) and the sun wheel (71) being arranged co-axially to each other.

4. A sewing automat according to claim 3, wherein the diameter (d') of the sun wheel (71) is unequal the diameter (D) of the gear wheel (81).

* * * * *